US011668168B2

(12) United States Patent
Parsegov et al.

(10) Patent No.: US 11,668,168 B2
(45) Date of Patent: Jun. 6, 2023

(54) DETECTION OF WELLBORE FAULTS BASED ON SURFACE PRESSURE OF FLUIDS PUMPED INTO THE WELLBORE

(71) Applicant: Halliburton Energy Services, Inc., Houston, TX (US)

(72) Inventors: Sergei Parsegov, Houston, TX (US); Stanley Vernon Stephenson, Duncan, OK (US); Tirumani Swaminathan, Houston, TX (US); Daniel Joshua Stark, Houston, TX (US); Baidurja Ray, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 43 days.

(21) Appl. No.: 17/459,581

(22) Filed: Aug. 27, 2021

(65) Prior Publication Data

US 2023/0066612 A1 Mar. 2, 2023

(51) Int. Cl.

| | |
|---|---|
| ***E21B 43/26*** | (2006.01) |
| ***E21B 47/18*** | (2012.01) |
| ***E21B 47/095*** | (2012.01) |
| ***E21B 47/06*** | (2012.01) |
| ***E21B 43/14*** | (2006.01) |

(52) U.S. Cl.

CPC ..... *E21B 43/14* (2013.01); *E21B 43/26* (2013.01); *E21B 47/06* (2013.01); *E21B 47/095* (2020.05); *E21B 47/18* (2013.01)

(58) Field of Classification Search

CPC .. E21B 43/26; E21B 43/2605; E21B 43/2607; E21B 43/27; E21B 47/06; E21B 47/095; E21B 47/18

See application file for complete search history.

(56) References Cited

U.S. PATENT DOCUMENTS

| | | | | |
|---|---|---|---|---|
| 9,726,558 | B2 * | 8/2017 | Chin | G01L 1/247 |
| 9,797,395 | B2 * | 10/2017 | Urdaneta | F04B 9/045 |
| 9,957,763 | B2 * | 5/2018 | Greening | E21B 34/14 |
| 10,253,599 | B2 | 4/2019 | Dykstra et al. | |
| 2004/0199361 | A1 | 10/2004 | Lu et al. | |
| 2005/0096759 | A1 | 5/2005 | Benjamin, IV et al. | |
| 2007/0175633 | A1 | 8/2007 | Kosmala et al. | |

(Continued)

FOREIGN PATENT DOCUMENTS

| | | | |
|---|---|---|---|
| WO | 2020/131085 | A1 | 6/2020 |
| WO | 2020131100 | A1 | 6/2020 |

*Primary Examiner* — Catherine Loikith

(74) *Attorney, Agent, or Firm* — Delizio, Peacock, Lewin & Guerra

(57) ABSTRACT

A system is provided including at least one pump for pumping a fluid into a wellbore, a pressure sensor provided at a wellhead of the wellbore for measuring a backpressure of the fluid being pumped into the wellbore, and a diagnostic manager. The diagnostic manager obtains pressure data associated with a pressure signal from the pressure sensor, wherein the pressure data includes pressure measurements of the fluid over a selected time period. The diagnostic manager converts, based on the pressure data, at least a portion of the pressure signal into frequency domain. The diagnostic manager detects a change in frequency of the pressure signal in the Fourier spectrum and determines that a fault associated with the wellbore has occurred based on the changed frequency of the pressure signal.

24 Claims, 9 Drawing Sheets

(56) References Cited

U.S. PATENT DOCUMENTS

| | | | | |
|---|---|---|---|---|
| 2017/0096889 | A1 | 4/2017 | Blanckaert et al. | |
| 2018/0266198 | A1* | 9/2018 | Manum | G01F 1/74 |
| 2020/0072997 | A1* | 3/2020 | Felkl | G01V 1/46 |
| 2020/0256177 | A1 | 8/2020 | Mazrooee et al. | |

* cited by examiner

DETECTION OF WELLBORE FAULTS BASED ON SURFACE PRESSURE OF FLUIDS PUMPED INTO THE WELLBORE

TECHNICAL FIELD

The present disclosure relates generally to well operations and, more particularly, to detection of faults related to a wellbore based on surface pressure of fluids pumped into the wellbore.

BACKGROUND

Subterranean hydraulic fracturing (alternately referred to as "fracking") is sometimes conducted to increase or stimulate production from hydrocarbon-producing wells. In hydraulic fracturing, a fracturing fluid is pumped at an elevated pressure from a wellbore into adjacent hydrocarbon-bearing subterranean formations. The pumped fracturing fluid splits or "fractures" the rock formation along veins or planes extending laterally from the wellbore. In some applications, the fracturing fluid contains propping agents (alternately referred to as "proppant") that are also injected into the opened fractures. Once a desired fracture network is formed, the fluid flow is reversed, and the liquid portion of the fracturing fluid is removed. The proppant is intentionally left behind to prevent the fractures from closing onto themselves due to the weight and stresses within the formation. Accordingly, the proppant quite literally "props" or supports the fractures to remain open yet remain permeable to hydrocarbon fluid flow since they form a packed bed of particles with interstitial void space connectivity.

One of the most common techniques used for wellbore completions today is plug and perf. Plug and perf is a cased hole completion approach which entails the placement (or pumping down) of a bridge plug and perforation (perf) gun to the desired stage in a well bore. Once the plug is set, the perf gun fires holes in the casing, penetrating the reservoir section prior to the plug just set. Next, the perf gun is removed from the wellbore. Then hydraulic fracturing takes place, and the fracturing fluid is pumped into this same perforated section. The process is repeated for each stage, the downhole tools moving from the end of the wellbore back toward the beginning until all the stages have been fractured. The plugs are then drilled or milled out before hydrocarbon production is initiated.

Multistage hydraulic fracturing with plug and perf technique requires reliable stage isolation at pressure differentials up to 10,000 psi over the plug that is usually installed in casings that are deformed by earth stress differentials. Further, high rate abrasive slurry with small size sand particles creates an ideal environment for the erosional failure of the plug during pumping. In the most severe case, the plug may lose mechanical integrity and sealing capability with the casing and move downhole causing frac clusters of the previous stage to take fluid. Reliable methods are needed which can accurately detect plug failures and location of such failures within the wellbore so that appropriate remedial actions may be taken.

BRIEF DESCRIPTION OF DRAWINGS

Some specific exemplary aspects of the disclosure may be understood by referring, in part, to the following description and the accompanying drawings.

Figure 1:
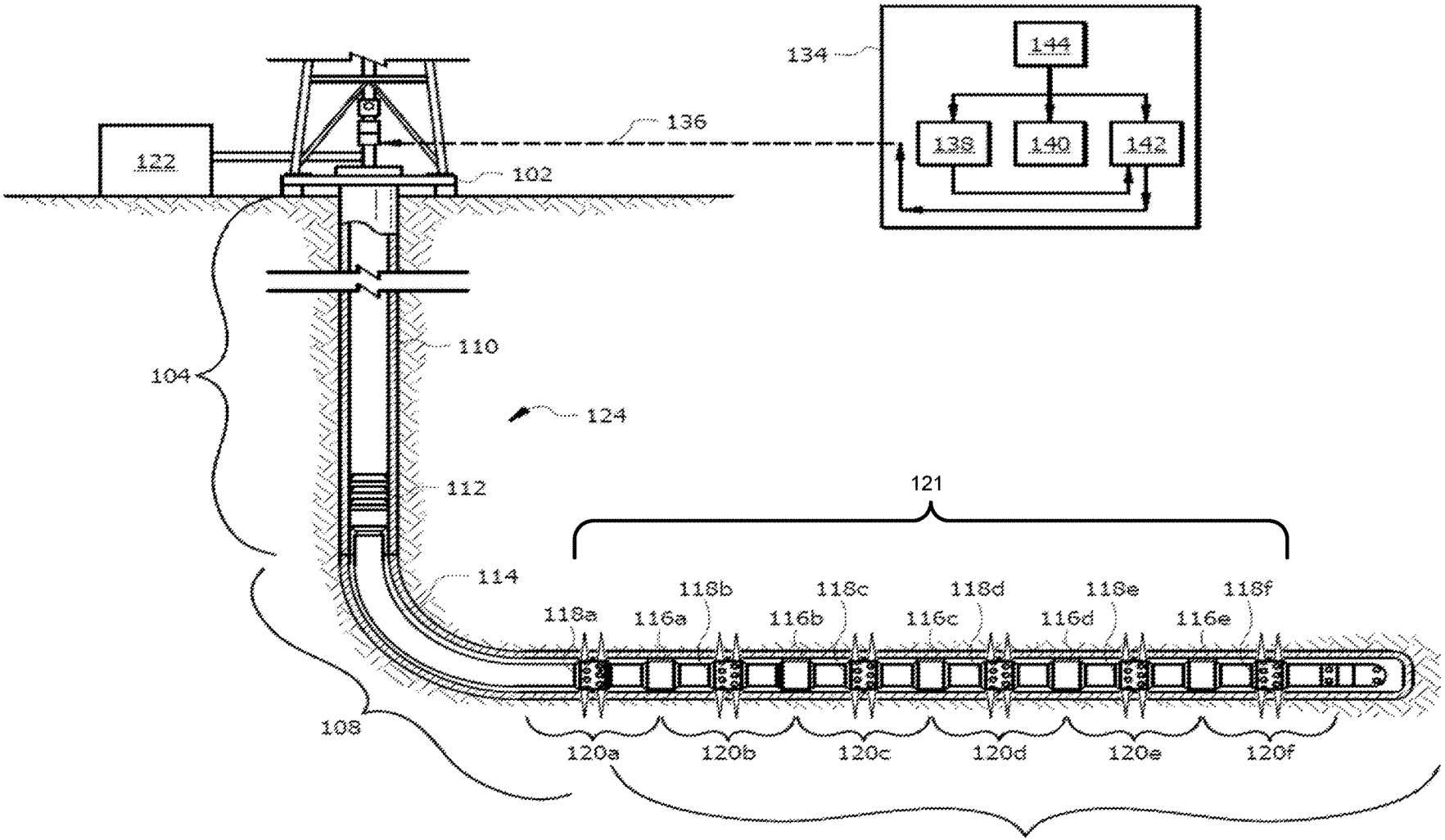
FIG. 1 is a schematic of a well system following a multiple-zone completion operation.

While aspects of this disclosure have been depicted and described and are defined by reference to exemplary aspects of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described aspects of this disclosure are examples only, and not exhaustive of the scope of the disclosure.

DETAILED DESCRIPTION

Aspects of the present disclosure provide improved techniques for detecting a wellbore fault based on measured surface pressure of a fluid being pumped into the wellbore. For example, the techniques discussed herein include detecting movement of a frac plug while a multi-stage hydraulic fracturing operation is in progress using a plug and perforation technique. As discussed in the following disclosure, the frequency of oscillation of an oscillating pressure pulse in the wellbore is a reliable indicator of a fault (e.g. frac plug movement) that generated the pressure pulse and the depth or location of the fault in the wellbore. Thus, the techniques discussed herein include analyzing a surface pressure signal of a treatment fluid being pumped into the wellbore in the frequency domain to determine an oscillation frequency of the pressure signal. A wellbore fault including movement of a frac plug may be detected based on changes in the oscillation frequency of the surface pressure signal.

It may be noted that while embodiments of the present disclosure are described with reference to a plug and perforation technique based hydraulic fracturing systems, a person of ordinary skill in the art can appreciate that the disclosed methods apply to ball-activated and coil-tubing activation multistage hydraulic fracturing systems.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. It may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (for example, a hard disk drive or floppy disk drive), a sequential access storage device (for example, a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Illustrative aspects of the present disclosure are described in detail herein. In the interest of clarity, not all features of an actual implementation may be described in this specification. It will of course be appreciated that in the development of any such actual aspect, numerous implementation-specific decisions are made to achieve the specific implementation goals, which will vary from one implementation to another. Moreover, it will be appreciated that such a development effort might be complex and time-consuming, but would, nevertheless, be a routine undertaking for those of ordinary skill in the art having the benefit of the present disclosure.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

To facilitate a better understanding of the present disclosure, the following examples of certain aspects are given. In no way should the following examples be read to limit, or define, the scope of the invention. Aspects of the present disclosure may be applicable to horizontal, vertical, deviated, or otherwise nonlinear wellbores in any type of subterranean formation. Aspects may be applicable to injection wells as well as production wells, including hydrocarbon wells. Aspects may be implemented using a tool that is made suitable for testing, retrieval and sampling along sections of the formation. Aspects may be implemented with tools that, for example, may be conveyed through a flow passage in tubular string or using a wireline, slickline, coiled tubing, downhole robot or the like. "Measurement-while-drilling" ("MWD") is the term generally used for measuring conditions downhole concerning the movement and location of the drilling assembly while the drilling continues. "Logging-while-drilling" ("LWD") is the term generally used for similar techniques that concentrate more on formation parameter measurement. Devices and methods in accordance with certain aspects may be used in one or more of wireline (including wireline, slickline, and coiled tubing), downhole robot, MWD, and LWD operations.

FIG. 1 is a schematic of a well system 100 following a multiple-zone completion operation. Various types of equipment such as a rotary table, drilling fluid or production fluid pumps, drilling fluid tanks (not expressly shown), and other drilling, completion or production equipment may be located at well surface or well site 102. A wellbore extends from a surface and through subsurface formations. The wellbore has a substantially vertical section 104 and a substantially horizontal section 106, the vertical section 104 and horizontal section 106 being connected by a bend 108. The horizontal section 106 extends through a hydrocarbon bearing formation 124. One or more casing strings 110 are inserted and cemented into the vertical section 104 to prevent fluids from entering the wellbore. Fluids may comprise any one or more of formation fluids (such as production fluids or hydrocarbons), water, mud, fracturing fluids, or any other type of fluid that may be injected into or received from the formation 124.

Although the wellbore shown in FIG. 1 includes a horizontal section 106 and a vertical section 104, the wellbore may be substantially vertical (for example, substantially perpendicular to the surface), substantially horizontal (for example, substantially parallel to the surface), or may comprise any other combination of horizontal and vertical sections.

The well system 100 depicted in FIG. 1 is generally known as an open hole well because the casing strings 110 do not extend through the bend 108 and horizontal section 106 of the wellbore. As a result, the bend 108 and horizontal section 106 of the wellbore are "open" to the formation. In another embodiment, the well system 100 may be a closed hole type in which one or more casing strings 110 are inserted in the bend 108 and the horizontal section 106 and cemented in place. In some embodiments, the wellbore may be partially completed (for example, partially cased or cemented) and partially uncompleted (for example, uncased and/or uncemented).

Well system 100 may include a well flow control 122. Although the well flow control 122 is shown as associated with a drilling rig at the well site 102, portions or all of the well flow control 122 may be located within the wellbore. For example, well flow control 122 may be located at well site 102, within wellbore at a location different from the location of a downhole tool 121, or within a lateral wellbore. In operation, well flow control 122 controls the flow rate of fluids. In one or more embodiments, well flow control 122 may regulate the flow rate of a fluid into or out of the wellbore, into or out of the formation via the wellbore or both. Fluids may include hydrocarbons, such as oil and gas, other natural resources, such as water, a treatment fluid, or any other fluid within a wellbore.

The embodiment in FIG. 1 includes a top production packer 112 disposed in the vertical section 104 of the wellbore that seals against an innermost surface of the casing string 110. Production tubing 114 (also referred to as work string) extends from the production packer 112, along the bend 108 and extends along the horizontal section 106 of the wellbore. The production tubing 114 may also be used to inject hydrocarbons, production chemicals and other natural resources into the formation 124 via the wellbore. The production tubing 114 may include multiple sections that are coupled or joined together by any suitable mechanism to allow production tubing 114 to extend to a desired or predetermined depth in the wellbore. Disposed along the production tubing 114 may be various downhole tools including packers 116A-E and sleeves 118A-F. The packers 116A-E engage the inner surface of the horizontal section 106, dividing the horizontal section 106 into a series of production zones 120A-F. In some embodiments, suitable packers 116A-E include, but are not limited to compression set packers, swellable packers, inflatable packers, any other downhole tools, equipment, or devices for isolating zones, or any combination thereof.

Each of the sleeves 118A-F is generally operable between an open position and a closed position such that in the open position, the sleeves 118A-F allow communication of fluid between the production tubing 114 and the production zones 120A-F. In one or more embodiments, the sleeves 118A-F may be operable to control fluid in one or more configurations. For example, the sleeves 118A-F may operate in an intermediate configuration, such as partially open, which may cause fluid flow to be restricted, a partially closed configuration, which may cause fluid flow to be less restricted than when partially open, an open configuration which does not restrict fluid flow or which minimally restricts fluid flow, a closed configuration which restricts all fluid flow or substantially all fluid flow, or any position in between.

During production, fluid communication is generally from the formation 124, through the sleeves 118A-F (for example, in an open configuration), and into the production tubing 114. The packers 116A-F and the top production packer 112 seal the wellbore such that any fluid that enters the wellbore below the production packer 112 is directed through the sleeves 118A-F, the production tubing 114, and the top production packer 112 and into the vertical section 104 of the wellbore.

Communication of fluid may also be from the production tubing 114, through the sleeves 118A-F and into the formation 124, as is the case during hydraulic fracturing. Hydraulic fracturing is a method of stimulating production of a well and generally involves pumping specialized fracturing fluids down the well and into the formation. As fluid pressure is increased, the fracturing fluid creates cracks and fractures in the formation and causes them to propagate through the formation. As a result, the fracturing creates additional communication paths between the wellbore and the formation. Communication of fluid may also arise from other stimulation techniques, such as acid stimulation, water injection, and carbon dioxide ($CO_2$) injection.

In wells having multiple zones, such as zones 120A-F of the well system 100 depicted in FIG. 1, it is often necessary to fracture each zone individually. To fracture only one zone, the zone is isolated from other zones and fracturing fluid is prevented from entering the other zones. In one or more embodiments, sliding sleeve tools 118A-F may be omitted from the well system 100 and the lateral wellbore section 106 may instead be lined with casing (e.g., the casing string 110) and perforated in strategic locations to facilitate fluid communication between the interior of the casing and each corresponding zone 120A-F. In such embodiments, the wellbore may nonetheless be stimulated using the systems and methods described herein by hydraulically fracturing the formation 124 via the perforations.

To facilitate hydraulic fracturing of the formation 124, the system 100 may also include a fracturing control system 134. The fracturing control system 134 communicates with the production tubing 114 (or alternatively the casing string 110) so that a prepared fracturing fluid 136 can be pumped down the production tubing 114 and into selected zones 120A-F to fracture the formation 124 adjacent the corresponding zones 120A-F. As illustrated, the fracturing control system 134 includes a fluid system 138, a proppant system 140, a pump system 142, and a master controller 144. In some embodiments, as illustrated, the fracturing control system 134 may be arranged at the surface adjacent to the well site 102. In other embodiments, however, at least the master controller 144 may be remotely located and able to communicate with the systems 138, 140, 142 via wired or wireless telecommunication means.

The fluid system 138 may be used to mix and dispense the fracturing fluid 136 having desired fluid properties (e.g., viscosity, density, fluid quality, etc.). The fluid system 138 may include a blender and sources of known substances that are combined in the blender to produce the fracturing fluid 136. The blending and mixing of the known substances are controlled under operation of the master controller 144.

The proppant system 140 may include proppant contained in one or more proppant storage devices, and a transfer apparatus that conveys the proppant from the storage device (s) to the fluid system 138 for blending. In some applications, the proppant system 140 may also include a proportional control device responsive to the master controller 144 to drive the transfer apparatus at a desired rate and thereby add a desired or predetermined quantity of proppant to the fracturing fluid 136.

The pump system 142 receives the prepared fracturing fluid 136 from the fluid system 138 and includes a series of positive displacement pumps (referred to as fracturing or "frac" pumps) that inject the fracturing fluid 136 into the wellbore 106 under specified pressures and at predetermined flow rates. Operation of the pumps of the pump system 142, including manipulation of the pump rate, is controlled by the master controller 144. Each pump may be indicative of a single, discrete pumping device, but could alternatively comprise multiple pumps included on or forming part of a pump truck stationed at or near the well site 102. All of the pumps (or pump trucks) included in the pump system 142 may or may not be the same type, size, configuration, or from the same manufacturer. Rather, some or all of the pumps may be unique in size, output capability, etc.

The master controller 144 includes hardware and software (e.g., a programmed computer) that allow a well operator to manually or autonomously control the fluid, proppant, and pump systems 138, 140, 142. Data from the fracturing operation, including real-time data from the wellbore 106 and the systems 138, 140, 142 is received and processed by the master controller 144 to provide monitoring and other informational displays to the well operator. In response to such real-time data, the master controller 144 provides control (command) signals to the systems 138, 140, 142 to trigger and adjust operation. Such control signals can either be conveyed manually, such as via functional input from the well operator, or automatically (autonomously), such as via programming included in the master controller 144 that automatically operates in response to real-time data triggers.

Figure 2A:
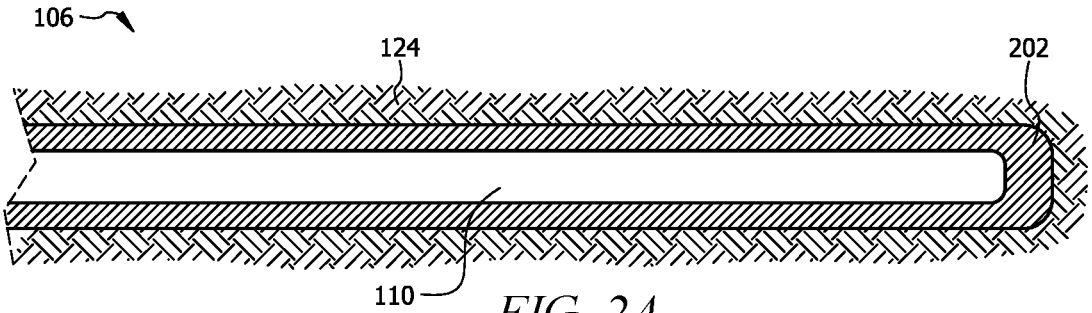
FIGS. 2A-2K illustrate an example wellbore completion using the plug and perf technique.
Figure 2B:
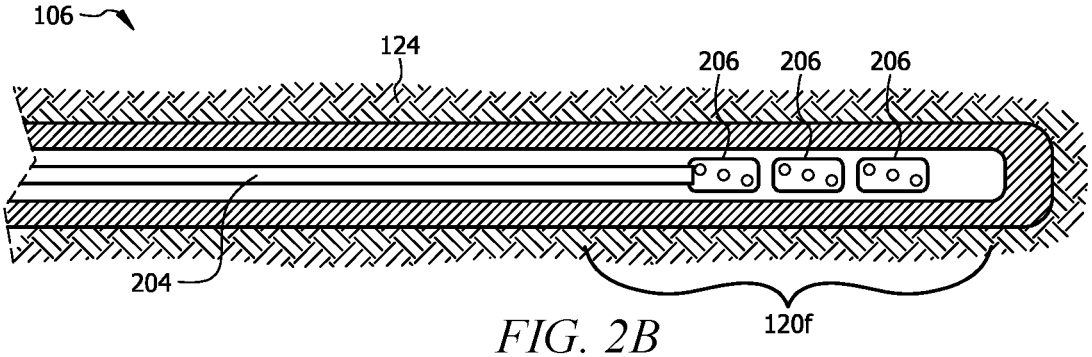
Figure 2C:
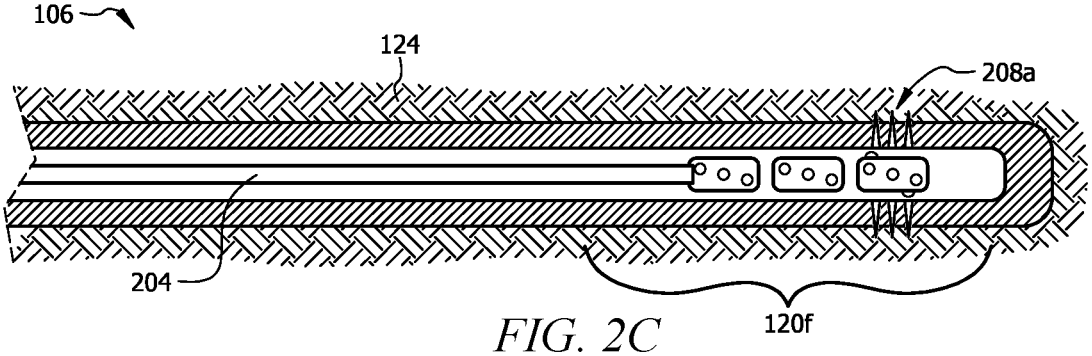
Figure 2D:
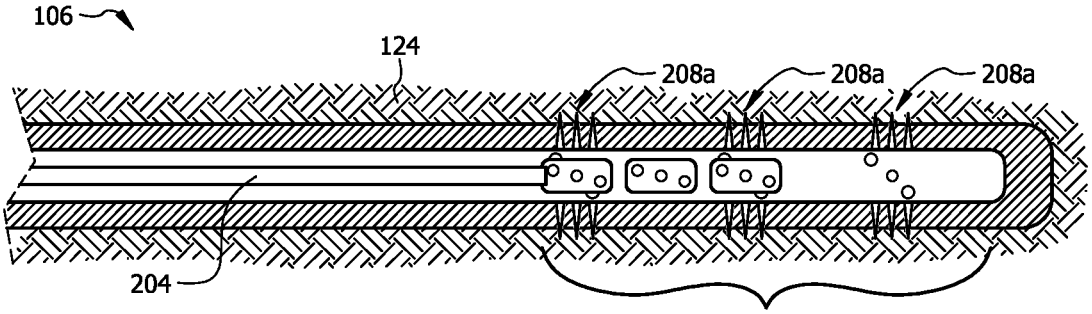
Figure 2E:
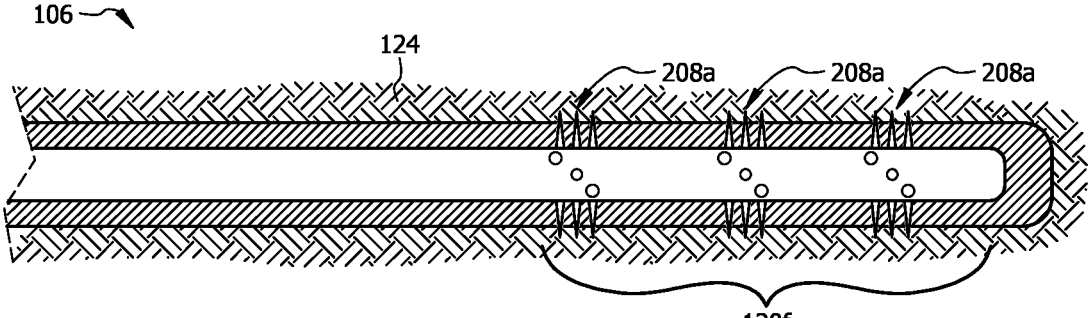
Figure 2F:
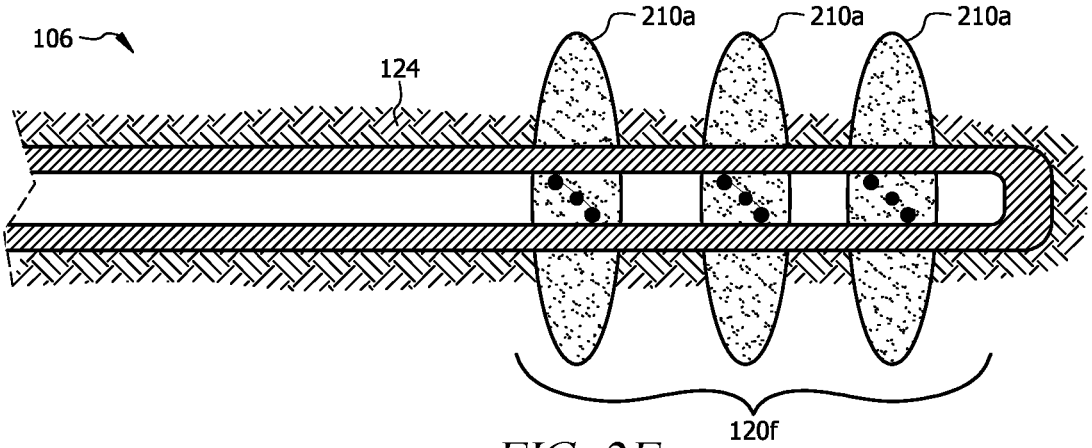

FIGS. 2A-2K illustrate an example wellbore completion using the plug and perf technique. FIGS. 2A-2K illustrate multi-stage hydraulic fracturing using the plug and perf technique for wellbore completion in the horizontal section 106 of the wellbore illustrated in FIG. 1. As shown in FIG. 2A, the completion process is started by inserting the casing string 110 into the horizontal section 106 of the wellbore. Once the casing 110 is in place in the wellbore at the intended depth, cement 202 is pumped through the casing 110 into the annulus between the casing 110 and the formation 124, providing isolation in the wellbore so that fluids cannot flow between the formation and the interior of the casing 110. Once the cement is setup, the fracturing operation may begin. As shown in FIG. 2B coiled tubing 204 having perforation guns 206 attached to the end of the coiled tubing 204 is run into the wellbore. Once the perforation guns 206 are in place within the production zone 120F of the wellbore, the perforation guns 206 are fired one by one at various positions within production zone 120F to form a cluster of perforations 208*a*. As shown in FIGS. 2C and 2D, perforations 208*a* puncture holes through the casing 110 and the cement 202 into the formation 124 to regain access to the formation 124. Once the first cluster of perforations 208*a* are formed in production zone 120F, the coiled tubing 204 along with the perforation guns 206 are pulled out of the wellbore as shown in FIG. 2E. Once the coiled tubing 204 is pulled out of the wellbore, the fracturing control system 134 may pump fracturing fluid 136 down the casing 110 to fracture the formation 124 adjacent to the production zone 120F through the perforations 208*a* previously formed in the zone 120F. As shown in FIG. 2F fractures 210*a* have been formed in the formation 124 adjacent to production zone 120F.

Figure 2G:
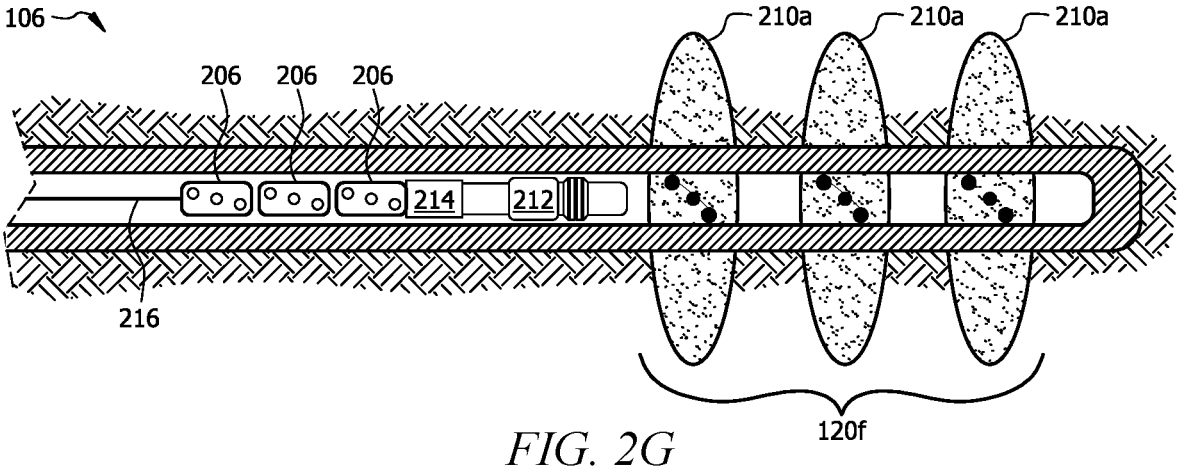
Figure 2H:
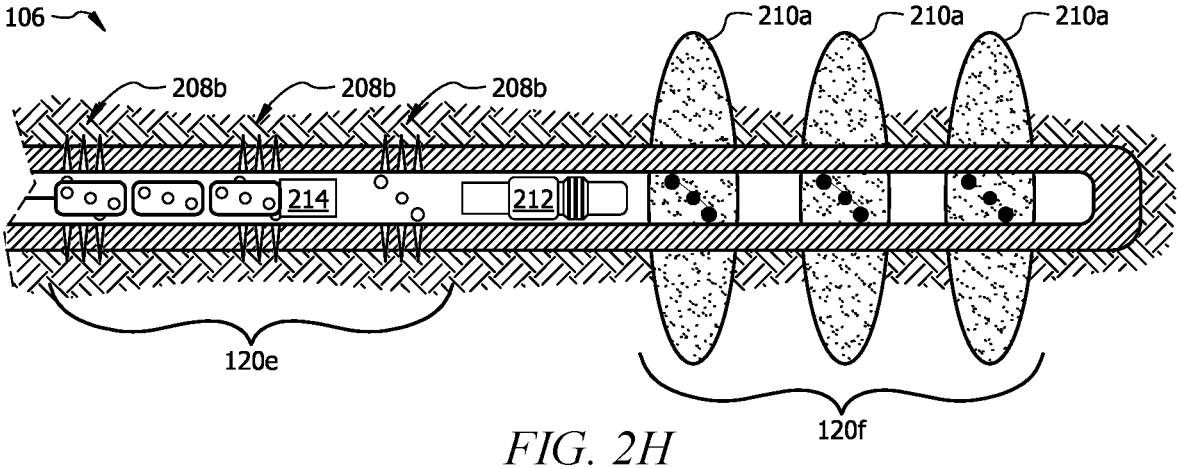
Figure 2I:
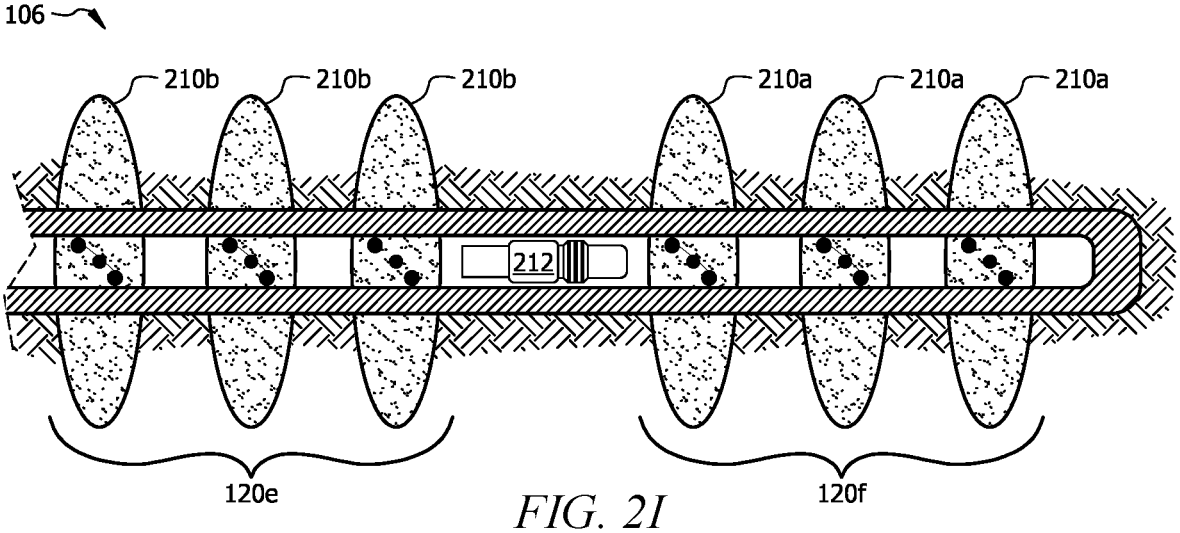

Once the first set of fractures 210*a* has been formed, a wireline assembly may be pumped down (e.g., by pumping fluid into the wellbore, through the perforations and into the formation). As shown in FIG. 2G, the wireline assembly includes a frac plug 212 at the bottom of the assembly, a setting tool 214 above the frac plug 212 and perforation guns 206 above the setting tool 214. Once the wireline assembly is at the intended depth within the wellbore, an electrical signal may be sent to the setting tool 214 through the wireline 216 to set the frac plug 212 and to isolate production zone 120F from the remaining wellbore section through to the surface. As shown in FIG. 2H, once the frac plug 212 is set, the setting tool 214 releases the frac plug 212 so that the wireline 216 may be moved up the wellbore. When the perforation guns 206 are moved up and in position at the next production zone 120E within the wellbore (as shown in FIG. 2H), an electrical signal may be sent down the wireline to fire the perforating guns 206 one by one at various positions within production zone 120E (e.g., by moving the wireline 216 between perforating positions) to form a second cluster of perforations 208*b*. Once the second cluster of perforations 208*b* are formed in production zone 120F, the wireline 216 along with the perforation guns 206 are pulled out of the wellbore and the fracturing control system 134 pumps fracturing fluid 136 down the casing 110 to fracture the formation 124 adjacent to the production zone 120E through the perforations 208*b* previously formed in the zone 120E. As shown in FIG. 21 fractures 210*b* have been formed in the formation 124 adjacent to production zone 120E.

Figure 2J:
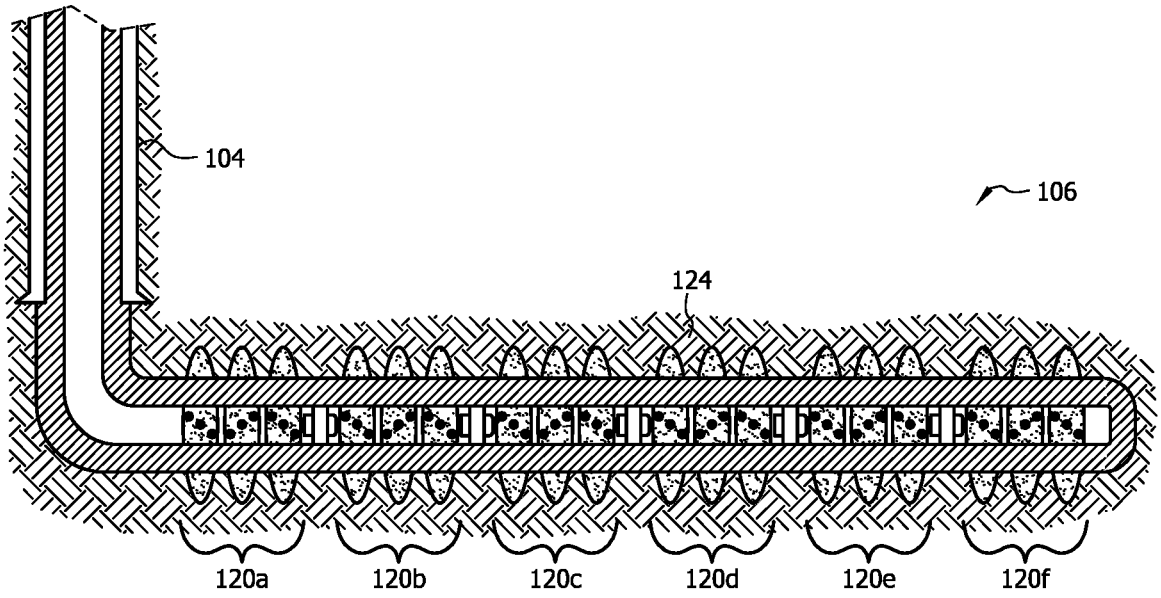
Figure 2K:
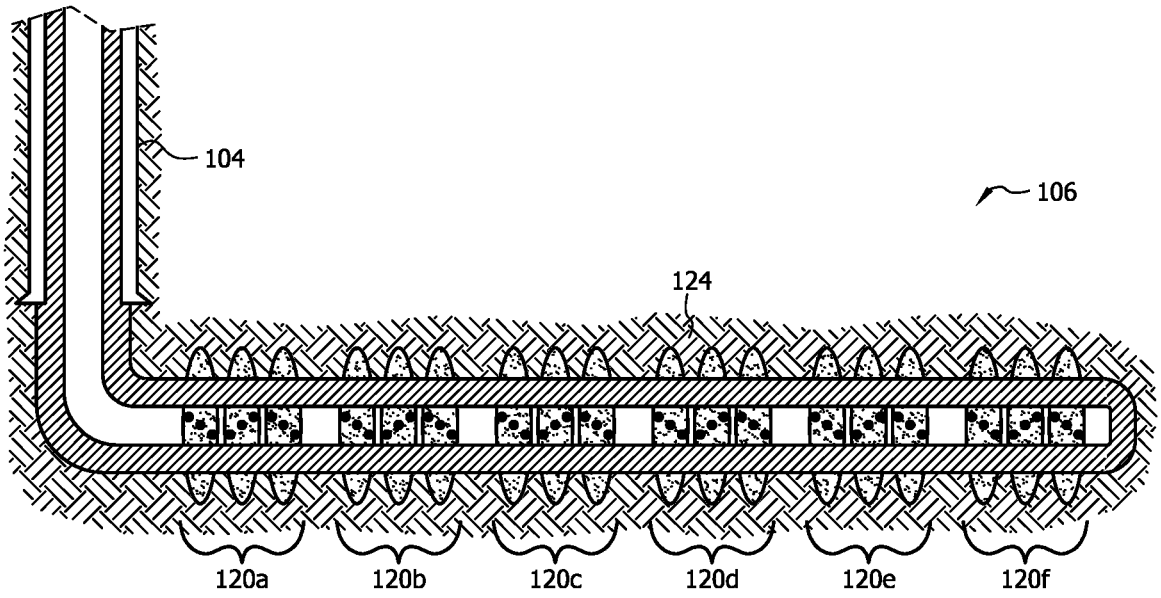

The above plugging and perforation process is repeated until all zones 120A-F are perforated as shown in FIG. 2J. Once all zones 120A-F are perforated and fractured, the frac plugs between the zones 120A-F are removed as shown in FIG. 2K, for example by milling out the plugs. Once the frac plugs 212 are removed from the wellbore, the wellbore is ready for production.

When fracturing fluid 136 is being pumped into the wellbore to form fractures (e.g., 210*b*) in the formation 124 adjacent to a production zone (e.g., 120E), the fluid pressure needed to penetrate the formation 124 is generated by the fluid flow pumped into the wellbore pressing against a frac plug 212 that prevents the fracturing fluid 136 from flowing to a previous production zone (e.g. 120F). For example, referring to FIG. 21, when the fracturing fluid 136 is pumped into the wellbore to form fractures 210*b* in the formation 124 adjacent to production zone 120E, the flow of the fracturing fluid 136 presses against frac plug 212 which isolates zone 120E from the previous zone 120F. This generates sufficient fluid pressure allowing the fracturing fluid 136 to penetrate the formation 124 to form fractures 210*b*. The amount of fluid pressure created within the wellbore is a function of the pumping rate of the fracturing fluid 136. The pressure of the fracturing fluid 136 within the wellbore may be measured as a surface pressure (also referred to as back pressure) by one or more pressure sensors provided on the surface at the wellhead 102.

When a fracturing job is in progress, every change in pressure downhole in the wellbore generates an oscillating pressure pulse that travels back and forth through the fracturing fluid 136 between the source of the pressure change and the surface. The oscillating pressure pulse usually decays over a few oscillation periods. A pressure pulse may be caused by several factors including, but not limited to, flowrate changes, fracture growth, frac plug movement and flow step at a diversion. The pressure pulses may be measured by a pressure sensor at the wellhead. A period of oscillation of an oscillating pressure signal may be determined based on the surface pressure measurements of the fracturing fluid 136. A frequency of oscillation of the pressure signal may be determined as an inverse of the period of oscillation of the pressure signal. Assuming that the velocity of pressure signal travelling in the fracturing fluid remains constant, the frequency of oscillation of a pressure pulse is a function of the travel time between the source of the pressure pulse and the surface. Longer the pressure pulse must travel between the source and the surface, lower is the frequency of oscillation of the pressure pulse. On the other hand, shorter the pressure pulse must travel between the source and the surface, higher is the frequency of oscillation of the pressure pulse. Thus, the frequency of oscillation of an oscillating pressure pulse in the wellbore is a good indicator of the depth or location of the source that generated the pressure pulse downhole. In some cases, the oscillation frequency of a pressure pulse is also a good indicator of a fault (e.g. frac plug movement) that generated the pressure pulse. For example, a failure of a frac plug 212 and consequent movement of the plug 212 downhole from an original position of the plug 212 into a previous production zone may cause an oscillating pressure wave created as a result of the plug movement to have a lower frequency than a base frequency or range of frequencies associated with normal operation (e.g., before plug movement). The lower frequency may be a result of the pressure pulse having to travel longer between the surface and the new position of the frac plug 212 downhole from the original position of the frac plug 212. Thus, in this case, the lower frequency of the pressure signal may indicate failure and movement of the frac plug and the new position of the frac plug 212 in the wellbore.

Aspects of the present disclosure discuss techniques for detecting a fault within the wellbore and a location of the fault based on analysis of a surface pressure signal of a fluid being pumped into the wellbore.

Figure 3:
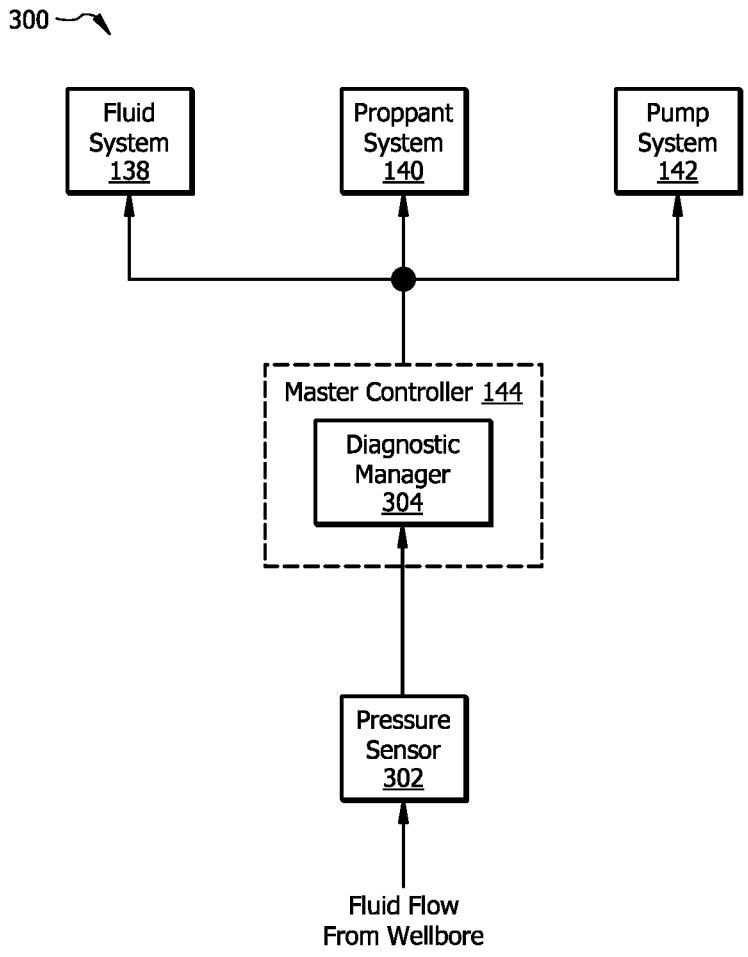
FIG. 3 illustrates a system for diagnosing faults related to plug and perf completion of a wellbore, in accordance with certain embodiments of the present disclosure.

FIG. 3 illustrates a system 300 for diagnosing faults related to plug and perf completion of a wellbore, in accordance with certain embodiments of the present disclosure.

As shown, system 300 includes a pressure sensor 302 disposed at the surface near the wellsite 102 that measures the surface pressure (also referred to as wellhead pressure) of fluids (e.g., fracturing fluid 136) being pumped into the wellbore. Diagnostic manager 304 is communicatively couped to the pressure sensor 302 and is configured to receive real-time pressure data relating to the fracturing fluid 136 being pumped into the wellbore. Diagnostic manager 304 is configured to analyze the pressure data recorded by the pressure sensor 302 and detect a downhole fault and a location of the fault based on the analysis. The detected downhole fault may include one or more of a movement of a frac plug 212 and a screen out.

In one or more embodiments, diagnostic manager 304 is part of the master controller 144 shown in FIG. 1. For example, the master controller 144 may be configured to perform operations of the diagnostic manager 304 disclosed herein. In alternative aspects, diagnostic manager 304 may be an independent system separate from the master controller 144 and communicatively coupled to the master controller 144. In this case, diagnostic manager 304 may be configured to send information relating to the detected wellbore fault and location of the fault to the master controller 144. The master controller 144 is configured to adjust operation of one or more of the fluid system 138, proppant system 140 and pump system 142, based on the nature of the detected fault (e.g., plug movement, screen out etc.) and the location of the fault in the wellbore. For example, master controller 144 may control the pump system 142 to adjust the pumping rate of the fracturing fluid 136. The master controller 144 may control the proppant system 140 to adjust the amount of proppant being added to the fracturing fluid 136. The master controller 144 may also control the fluid system 138 to adjust the composition of the fracturing fluid 136. The term "screen out" refers to a condition that occurs when solids carried in a treatment fluid, such as proppant in the fracturing fluid 136, create a bridge across perforations or similar restricted flow area. This creates a sudden and significant restriction to fluid flow that causes a rapid rise in pump pressure.

Diagnostic manager 304 may be configured to interpret a pressure signal based on pressure data received from pressure sensor 302. The pressure data received from the pressure sensor 302 may include measured pressure values of the fracturing fluid measured at the wellhead over time.

Figure 4:
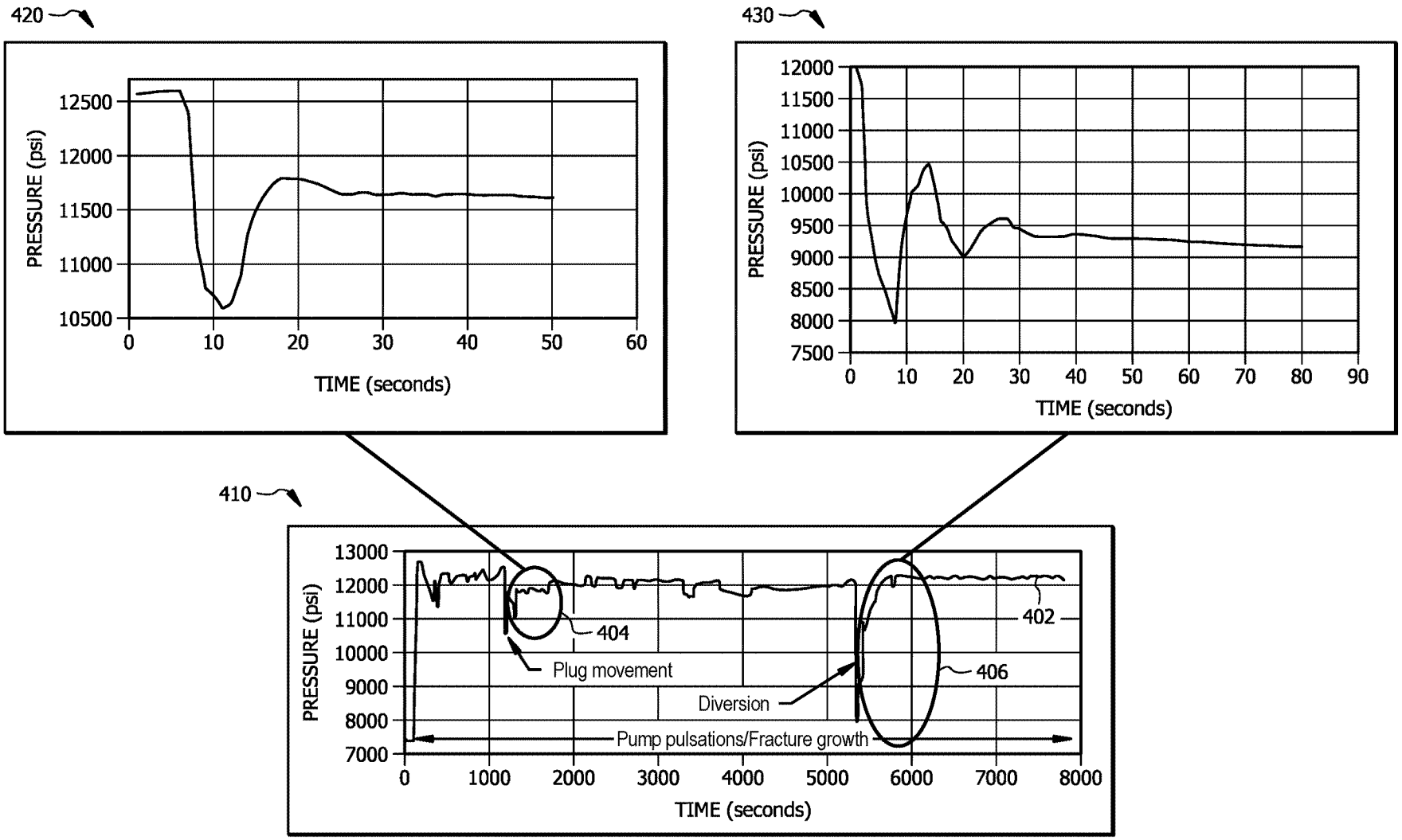
FIG. 4 illustrates an example plot of a time domain pressure signal, in accordance with certain embodiments of the present disclosure.

FIG. 4 illustrates an example plot of a time domain pressure signal, in accordance with certain embodiments of the present disclosure. Plot 410 shows a pressure signal 402 (e.g., wellhead pressure of a fracturing fluid) recorded when a fracturing operation is in progress. As shown, plot 410 plots measured pressure values of the fracturing fluid 136 against time. Throughout the entire fracturing operation, both pressure pulses from the pumps and pressure pulses from fracture growth in the formation 124 excite the wellbore. These excitation pressure pulses are represented in plot 410 by changes in pressure throughout the length of the plotted pressure signal 402. A fault event such as a frac plug movement (or a screen out) usually produces a sharp change in pressure creating a water hammer wave through the fracturing fluid that travels back and forth between the plug (or source of screen out) and the surface and decays after a few oscillation periods. For example, when a plug movement occurs, an excitation pulse is generated due to the sudden drop in pressure from fluid flow redirected further down the wellbore as the plug moves downhole. Time window 404 highlights a portion of the pressure signal 402 associated with a plug movement event. As shown in time window 404, a sharp drop in pressure (about 2000 psi) occurs when the plug moves downhole. The water hammer wave created by the sharp drop in pressure of the pressure signal 402 is more clearly illustrated in plot 420 which is a magnification of the pressure signal 402 in time window 404.

On the other hand, a screen out before the position of a frac plug 212 may be associated with a sharp increase in pressure of the pressure signal 402 as the screen out may restrict or completely cutoff fluid flow.

The pressure signal 402 at time window 406 is associated with use of a diverter. A diverter is usually a chemical agent or a mechanical device injected into the wellbore to ensure uniform distribution of a treatment fluid across a treatment interval. Injected fluids tend to follow the path of least resistance, possibly resulting in the least permeable areas receiving inadequate treatment. By using some means of diversion, the treatment can be focused on the areas requiring the most treatment. Diverters are usually employed on a temporary basis to enable full productivity of the well and removed after the desired areas of the formation are treated with fluid. Diverters are usually injected into the wellbore after suddenly and significantly lowering pumping rates resulting in a sharp decrease of pressure within the wellbore. As shown, the pressure signal 402 experiences a sharp decrease in pressure (about 6000 psi) when diversion is employed in the wellbore. This sharp drop in pressure of the pressure signal 402 associated with the use of diversion is more clearly illustrated in plot 430 which is a magnification of the pressure signal 402 in time window 406. The significance of the illustration of the pressure signal 402 during diversion will be clear from the following description with reference to FIG. 5.

Recorded wellhead pressure associated with the pressure signal 402 alone may not be a reliable indicator of a fault event such as a plug movement event or a screen out event. For example, several factors may contribute to a pressure drop in the fluid flow. For example, if the fracturing fluid 136 runs into a system of natural fractures, a geological fault or a void space or cavity within a fracture, these may result in a pressure drop. The pressure drop resulting from these effects may be indistinguishable from a pressure drop resulting from a fault event such as a plug failure. Further, different wells may be treated with fracturing fluids at different base pressures (e.g., fluid pumped at different rates) and pressure drops associated with similar fault events may not be the same across different wells.

However, the frequency signature associated with a particular fault event (e.g., plug failure) remains the same regardless of the amount of pressure change or the fluid base pressure at which the well is being treated. Additionally, the oscillation frequency of the pressure pulse between the surface and the source of fault helps determine the location of the fault as the frequency of oscillation is a function of the travel time of the pressure pulse between the surface and the fault location that generated the pressure pulse.

In one or more embodiments, diagnostic manager 304 may be configured to perform a frequency domain analysis of the surface pressure signal 402 in order to detect fault events such as plug movement and/or screen out, and to further determine a location of the fault in the wellbore. In certain embodiments, diagnostic manager 304 may be configured to convert the pressure signal 402 from time domain to frequency domain using Fast Fourier Transform (FFT), other Fourier Transforms, wavelet transforms, chirplet transforms, or other signal processing techniques that extract the frequency domain from the time domain.

Figure 5:
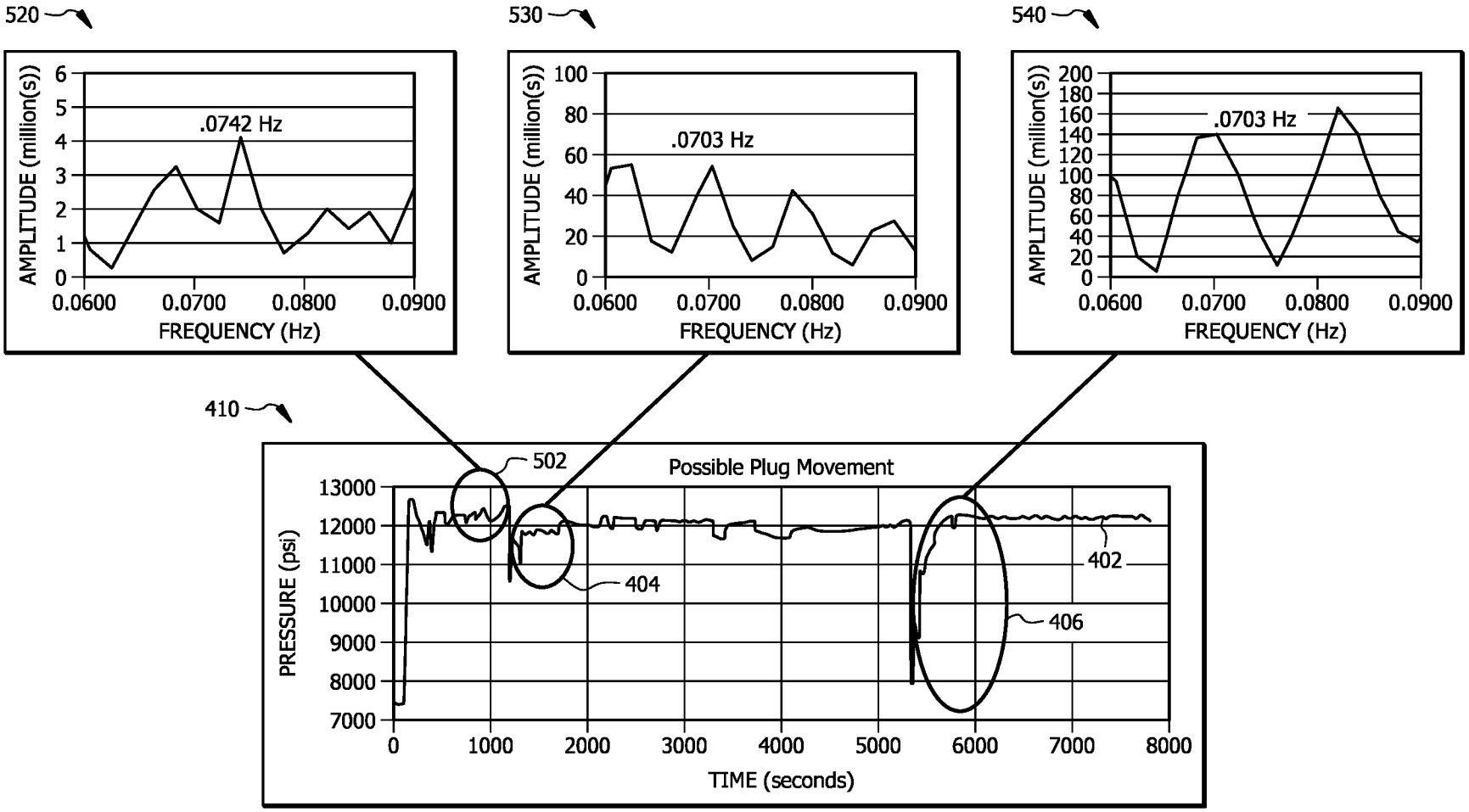
FIG. 5 illustrates an example representation of certain portions of the pressure signal of FIG. 4 in frequency domain, in accordance with certain embodiments of the present disclosure.

FIG. 5 illustrates an example representation of certain portions of the pressure signal 402 of FIG. 4 in frequency domain, in accordance with certain embodiments of the present disclosure. As described above with reference to FIG. 4, the portion of the pressure signal 402 in time window 404 represents a movement of the frac plug (e.g. frac plug 212). The pressure signal 402 before time interval 404 represents normal operation of the fracturing job before the plug movement event occurs in interval 404. Plot 520 represents the pressure signal 402 within time interval 502 before the plug movement occurs in Fourier spectrum. Similarly, plots 530 and 540 are Fourier spectrum representations of the pressure signal 402 in time intervals 404 and 406 respectively. Diagnostic manager 304 may use FFT to transform the pressure signal 402 in time intervals 502, 404 and 406 into frequency domain as shown in plots 520, 530 and 540 respectively. In one embodiment, diagnostic manager 304 may estimate an initial resonant frequency of the well based on known distance from the surface to the depth of the frac plug 212 (e.g. before plug movement) and the estimated speed of sound in the wellbore. In some embodiments, pressure pulses travel through the fracturing fluid 136 within the wellbore at the estimated speed of sound in the wellbore. In one embodiment, the diagnostic manager 304 may calculate the estimated speed of travel of a pressure pulse in the wellbore (e.g., estimated speed of sound in the wellbore) based on a known depth of a frac plug 212 (e.g., before plug movement) and a measured frequency of oscillation of the pressure signal 402. For example, diagnostic manager 304 may calculate the estimated speed of a pressure pulse in the wellbore by multiplying the known depth of the frac plug 212 and the frequency of oscillation of the pressure pulse 402.

As may be appreciated from comparing the plots 520 corresponding to time window 502 of the pressure signal 402 before the plug movement and plots 530 and 540 corresponding to time windows 404 and 406 after the plug movement event has occurred, the frequency of the pressure signal after the plug movement (after time 1200 seconds in plot 410) is lower (e.g., 0.703 Hz) than the frequency (0.742 Hz) before the plug movement (e.g., at time 900 seconds within time window 502). The lower frequency of the pressure signal is an indicator that the plug has moved further downhole thereby increasing the travel time of the pressure signal between the surface and the new position of the plug.

Further, plot 540 indicates that the frequency remains the same (when compared to plot 530) even when a diverter is employed and the back pressure of the fracturing fluid 136 drops significantly. This shows that the frequency of the pressure signal 402 is independent of the base pressure of the fluid. Thus, frequency of the pressure signal 402 is a more reliable indicator of a downhole fault such as movement of frac plug 212 as compared to the pressure of the pressure signal.

Thus, the diagnostic manager 304 may detect that the frac plug 212 has moved further downhole in response to determining that the oscillation frequency of the pressure signal 402 is lower than a previously recorded oscillation frequency.

In one or more embodiments, diagnostic manager 304 may determine how far the plug 212 has moved downhole based on the difference in frequencies of the pressure signal 402. Diagnostic manager 304 may be configured to determine the new depth of the moved plug 212 based on the known velocity of a pressure pulse within the wellbore and the new frequency of the pressure signal 402 recorded after movement of the plug is detected. For example, diagnostic manager 304 may calculate the depth of the plug by dividing the velocity by the frequency of the pressure signal 402.

In additional or alternative embodiments, diagnostic manager 304 may be configured to detect a screen out event based on frequency domain analysis of the pressure signal 402. For example, a screen out that occurred uphole from the frac plug 212 (such as at the perforations upstream of the plug) may translate into a higher oscillation frequency due to the shorter travel time a resulting pressure pulse has to travel between the surface and the location of screen out. The pressure decay rate for a screen out at the perforations can also be detected by a smaller decay rate in the oscillations due to less or no fluid leaving the wellbore through the perforations. Diagnostic manager 304 may be configured to determine that a screen out event has occurred in response to detecting that the frequency of the pressure signal 402 has increased as compared to a baseline frequency or range of frequencies and/or due to the lower decay rate in the oscillation. Diagnostic manager 304 may determine a depth of the screen out similar to how the diagnostic manager 304 determines a depth of the plug 212 as described above.

In one or more embodiments, the above described technique may be used to detect other faults related to the fracturing system. For example, faults related to the pump system 142 may be detected based on a similar frequency domain analysis of pressure signals between the pump system 142 and the pressure sensor 302.

In one or more embodiments, diagnostic manager 304 may use a combination of time domain analysis and frequency domain analysis of the surface pressure signal 402 to detect a downhole fault (e.g., plug movement, screen out etc.). For example, a plug movement in the wellbore results in a sudden pressure drop from fluid flow directed further down the wellbore as the plug moves downhole from a previous position of the plug. This plug movement event can be seen as a water-hammer wave in the time domain and a spectral peak in the frequency domain having a lower frequency value than a frequency or range of frequencies before the pressure drop occurred. The diagnostic manager 304 may be configured to determine that a plug movement event has occurred in response to detecting the water-hammer wave in the time domain and the spectral peak in the frequency domain.

As described above, diagnostic manager 304 may be configured to provide results of the time domain analysis and/or frequency domain analysis of the surface pressure signal 402 to the master controller 144. For example, diagnostic manager 304 may be configured to provide to the master controller 144 information relating to a detected downhole fault such as plug movement and screen out, and further a location of the detected fault in the wellbore (e.g., a new depth of a moved plug, depth of a screen out etc.). In response to receiving the information from the diagnostic manager 304, master controller 144 may be configured to take one or more actions including, but not limited to, rate reduction in pad stage, change sand concentration in the fluid, modify chemical composition of the fluid or a combination thereof, based on one or more pre-configured business priorities.

Figure 6:
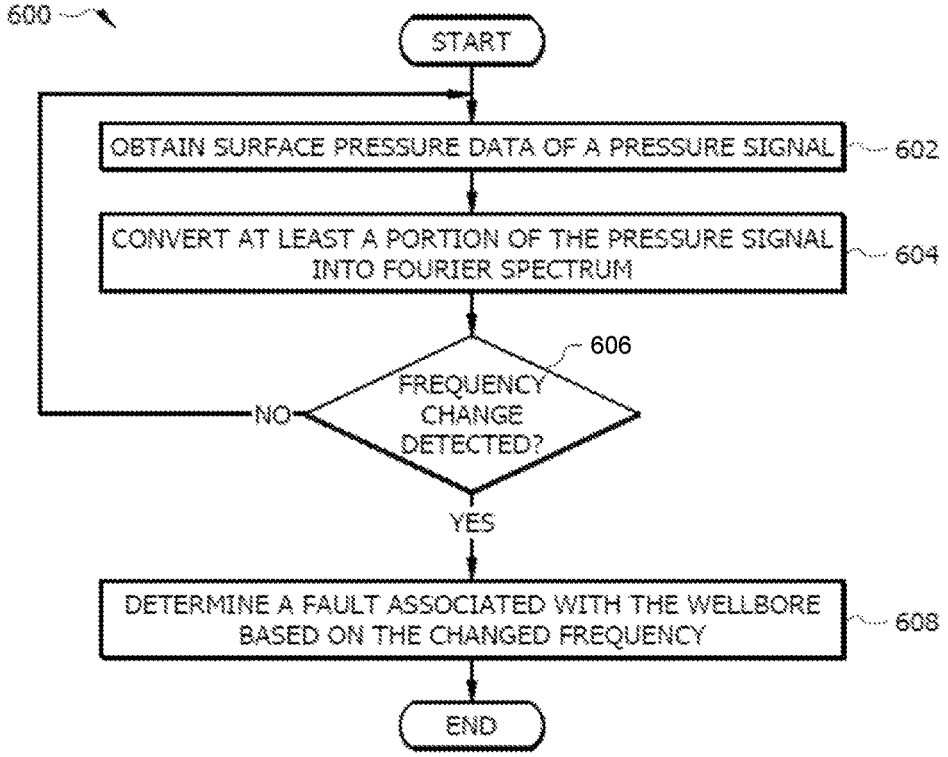
FIG. 6 illustrates example operations for detecting a fault associated with a wellbore, in accordance with certain embodiments of the present disclosure.

FIG. 6 illustrates example operations 600 for detecting a fault associated with a wellbore, in accordance with certain embodiments of the present disclosure. Operations 600 may be performed by the diagnostic manager 304 illustrated in FIG. 3.

At step 602, diagnostic manager 304 obtains pressure data associated with a pressure signal 402 from the pressure sensor 302, wherein the pressure data includes pressure measurements of the fluid over a selected time period. As described above, pressure sensor 302 may be disposed at the surface near the wellsite 102 that measures the surface pressure (also referred to as wellhead pressure or back pressure) of fluids (e.g., fracturing fluid 136) being pumped into the wellbore. Diagnostic manager 304 is communicatively couped to the pressure sensor 302 and is configured to receive real-time pressure data relating to the fracturing fluid 136 being pumped into the wellbore.

As described above, when a fracturing job is in progress, every change in pressure downhole in the wellbore generates an oscillating pressure pulse that travels back and forth through the fracturing fluid 136 between the source of the pressure change and the surface. The oscillating pressure pulse usually decays over a few oscillation periods. A pressure pulse may be caused by several factors including, but not limited to, flowrate changes, fracture growth, frac plug movement and flow step at a diversion. The pressure pulses may be measured by the pressure sensor 302 at the wellhead. Plot 410 (shown in FIG. 4) shows a pressure signal 402 recorded when a fracturing operation is in progress. As shown, plot 410 plots measured pressure values of the fracturing fluid 136 against time. Throughout the entire fracturing operation, both pressure pulses from the pumps and pressure pulses from fracture growth in the formation 124 excite the wellbore. These excitation pressure pulses are represented in plot 410 by changes in pressure throughout the length of the plotted pressure signal 402.

In one or more embodiments, diagnostic manager 304 is part of the master controller 144 shown in FIG. 1. For example, the master controller 144 may be configured to perform operations of the diagnostic manager 304 disclosed herein. In alternative aspects, diagnostic manager 304 may be an independent system separate from the master controller 144 and communicatively coupled to the master controller 144. In this case, diagnostic manager 304 may be configured to send information relating to the detected wellbore fault and location of the fault to the master controller 144. The master controller 144 is configured to adjust operation of one or more of the fluid system 138, proppant system 140 and pump system 142, based on the nature of the detected fault (e.g., plug movement, screen out etc.) and the location of the fault in the wellbore. For example, master controller 144 may control the pump system 142 to adjust the pumping rate of the fracturing fluid 136. The master controller 144 may control the proppant system 140 to adjust the amount of proppant being added to the fracturing fluid 136. The master controller 144 may also control the fluid system 138 to adjust the composition of the fracturing fluid 136. The term "screen out" refers to a condition that occurs when solids carried in a treatment fluid, such as proppant in the fracturing fluid 136, create a bridge across perforations or similar restricted flow area. This creates a sudden and significant restriction to fluid flow that causes a rapid rise in pump pressure but a reduced pressure oscillation decay rate from less fluid going through the perforations.

Diagnostic manager 304 may be configured to interpret the pressure signal 402 based on the pressure data received from pressure sensor 302. The pressure data received from the pressure sensor 302 may include measured pressure values of the fracturing fluid measured at the wellhead over time.

At step 604, diagnostic manager 304 converts, based on the pressure data obtained from the pressure sensor 302, at least a portion of the pressure signal 402 into Fourier spectrum by using Fourier Transform, wherein the Fourier spectrum represents the pressure signal in a frequency domain. For example, the Fourier transform separates out the frequency of oscillation of the pressure signal 402. The frequency spectrum can also be extracted using wavelets or other signal processing tools focused on converting the time domain data to frequency domain.

Diagnostic manager 304 may be configured to perform a frequency domain analysis of the surface pressure signal 402 in order to detect fault events such as plug movement and/or screen out, and to further determine a location of the fault in the wellbore. To accomplish this, diagnostic manager 304 may be configured to convert the pressure signal 402 from time domain to frequency domain using Fast Fourier Transform (FFT), wavelet transform or other signal processing tools. The pressure signal 402, when represented in the frequency domain, separates out the frequency of oscillation of the pressure signal 402. For example, plot 520 (as shown in FIG. 5) represents the pressure signal 402 within time interval 502 before the plug movement occurs in Fourier spectrum. Similarly, plots 530 and 540 are Fourier spectrum representations of the pressure signal 402 in time intervals 404 and 406 respectively. Diagnostic manager 304 may use FFT to transform the pressure signal 402 in time intervals 502, 404 and 406 into frequency domain as shown in plots 520, 530 and 540 respectively.

Assuming that the velocity of the pressure signal 402 travelling in the fracturing fluid remains constant, the frequency of oscillation of a pressure pulse is a function of the travel time between the source of the pressure pulse and the surface. Longer the pressure signal 402 must travel between the source and the surface, lower is the frequency of oscillation of the pressure signal 402. On the other hand, shorter the pressure signal 402 must travel between the source and the surface, higher is the frequency of oscillation of the pressure signal 402. Thus, the frequency of oscillation of an oscillating pressure signal 402 in the wellbore is a good indicator of the depth or location of the source that generated the pressure signal downhole. In some cases, the oscillation frequency of a pressure signal 402 is also a good indicator of a fault (e.g. frac plug movement) that generated the pressure signal 402. For example, a failure of a frac plug 212 and consequent movement of the plug 212 downhole from an original position of the plug 212 into a previous production zone may cause an oscillating pressure wave created as a result of the plug movement to have a lower frequency than a base frequency or range of frequencies associated with normal operation (e.g., before plug movement). The lower frequency may be a result of the pressure pulse having to travel longer between the surface and the new position of the frac plug 212 downhole from the original position of the frac plug 212. Thus, in this case, the lower frequency of the pressure signal 402 may indicate failure and movement of the frac plug and the new position of the frac plug 212 in the wellbore.

Accordingly, diagnostic manager 304 may detect a fault associated with the wellbore during a fracturing operation (e.g., movement of plug, screen out etc.) based on analyzing changes in frequency of the pressure signal 402. The analysis may include comparing the oscillation frequency of the pressure signal 402 before a plug movement to the oscillation frequency of the pressure signal 402 after a plug movement occurs. For example, by comparing the plots 520 corresponding to time window 502 of the pressure signal 402 before the plug movement and plots 530 and 540 corresponding to time windows 404 and 406 after the plug movement event has occurred, diagnostic manager 304 may detect that the frequency of the pressure signal after the plug movement (after time 1200 seconds in plot 410) is lower (e.g., 0.703 Hz) than the frequency (0.742 Hz) before the plug movement (e.g., at time 900 seconds within time window 502). The lower frequency of the pressure signal is an indicator that the plug has moved further downhole thereby increasing the travel time of the pressure signal between the surface and the new position of the plug. Thus, the diagnostic manager 304 may detect that the frac plug 212 has moved further downhole in response to determining that the oscillation frequency of the pressure signal 402 is lower than a previously recorded oscillation frequency.

At step 606, diagnostic manager 304 checks whether there was a change in the frequency of the pressure signal 402. If, diagnostic manager 304 does not detect a change in frequency of the pressure signal 402, operations 600 move back to step 602 where diagnostic manager 304 continues collecting real-time pressure data from the pressure sensor and continues analyzing the data as described above. On the other hand, if diagnostic manager 304 detects a change in frequency of the pressure signal 402, operations 600 proceed to step 608 where diagnostic manager determines that a fault associated with the wellbore has occurred based on the changed frequency of the pressure signal. For example, diagnostic manager 304 may interpret a decrease in the frequency of the pressure signal 402 as a plug movement event. In an additional or alternative embodiment. Diagnostic manager 304 may interpret an increase in the frequency of the pressure signal 402 as a screen out event especially if the increase in frequency in the frequency domain is accompanied by a reduction in the water hammer decay rate of the water hammer pressure wave in the time domain.

In one or more embodiments, diagnostic manager 304 may determine how far the plug 212 has moved downhole based on the difference in frequencies of the pressure signal 402. Diagnostic manager 304 may determine the new depth of the moved plug 212 based on the known velocity of a pressure pulse within the wellbore and the new frequency of the pressure signal 402 recorded after movement of the plug is detected. For example, diagnostic manager 304 may calculate the depth of the plug by dividing the velocity by the frequency of the pressure signal 402.

In additional or alternative embodiments, diagnostic manager 304 may detect a screen out event based on frequency domain analysis of the pressure signal 402 and/or time domain analysis of the water hammer pressure decay rate of signal 402. For example, a screen out that occurred uphole from the frac plug 212 may translate into a higher oscillation frequency due to the shorter travel time a resulting pressure pulse has to travel between the surface and the location of screen out. The higher oscillation frequency in the frequency domain is usually accompanied by a reduced decay rate of the water hammer pressure wave in the time domain due to less fluid leaving the wellbore through the perforations. Diagnostic manager 304 may be configured to determine that a screen out event has occurred in response to detecting that the frequency of the pressure signal 402 has increased as compared to a baseline frequency or range of frequencies and/or a decrease in the water hammer decay rate. Diagnostic manager 304 may determine a depth of the screen out similar to how the diagnostic manager 304 determines a depth of the plug 212 as described above.

In one or more embodiments, diagnostic manager 304 may use a combination of time domain analysis and frequency domain analysis of the surface pressure signal 402 to detect a downhole fault (e.g., plug movement, screen out etc.). For example, a plug movement in the wellbore results in a sudden pressure drop from fluid flow directed further down the wellbore as the plug moves downhole from a previous position of the plug. This plug movement event can be seen as a water-hammer wave in the time domain and a spectral peak in the frequency domain having a lower frequency value than a frequency or range of frequencies before the pressure drop occurred. The diagnostic manager 304 may determine that a plug movement event has occurred in response to detecting the water-hammer wave in the time domain and the spectral peak in the frequency domain.

Figure 7:
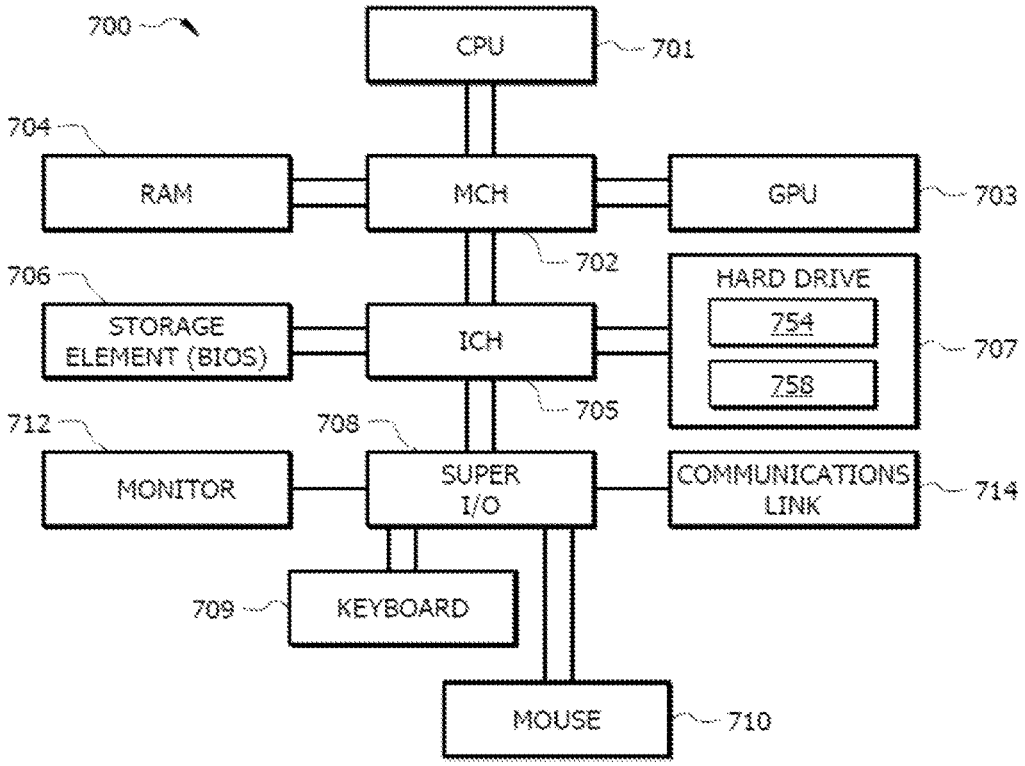
FIG. 7 is a diagram illustrating an example information handling system, in accordance with one or more embodiments of the present disclosure.

FIG. 7 is a diagram illustrating an example information handling system 700, for example, for use with well system 100 of FIG. 1, plug and perf technique of FIGS. 2A-2K or system 300 shown in FIG. 3, in accordance with one or more embodiments of the present disclosure. The master controller 144 and diagnostic manager 304 discussed above with reference to FIGS. 1 and 3 may take a form similar to the information handling system 700. A processor or central processing unit (CPU) 701 of the information handling system 700 is communicatively coupled to a memory controller hub (MCH) or north bridge 702. The processor 701 may include, for example a microprocessor, microcontroller, digital signal processor (DSP), application specific integrated circuit (ASIC), or any other digital or analog circuitry configured to interpret and/or execute program instructions and/or process data. Processor 701 may be configured to interpret and/or execute program instructions or other data retrieved and stored in any memory such as memory 704 or hard drive 707. Program instructions or other data may constitute portions of a software or application, for example application 758 or data 754, for carrying out one or more methods described herein. Memory 704 may include read-only memory (ROM), random access memory (RAM), solid state memory, or disk-based memory. Each memory module may include any system, device or apparatus configured to retain program instructions and/or data for a period of time (for example, non-transitory computer-readable media). For example, instructions from a software or application 758 or data 754 may be retrieved and stored in memory 704 for execution or use by processor 701. In one or more aspects, the memory 704 or the hard drive 707 may include or comprise one or more non-transitory executable instructions that, when executed by the processor 701 cause the processor 701 to perform or initiate one or more operations or steps. The information handling system 700 may be preprogrammed or it may be programmed (and reprogrammed) by loading a program from another source (for example, from a CD-ROM, from another computer device through a data network, or in another manner).

The data 754 may include treatment data, geological data, fracture data, seismic or micro seismic data, or any other appropriate data. In one or more aspects, a memory of a computing device includes additional or different data, application, models, or other information. In one or more aspects, the data 754 may include geological data relating to one or more geological properties of the subterranean formation (for example, formation 124 shown in FIG. 1). For example, the geological data may include information on the wellbore, completions, or information on other attributes of the subterranean formation. In one or more aspects, the geological data includes information on the lithology, fluid content, stress profile (for example, stress anisotropy, maximum and minimum horizontal stresses), pressure profile, spatial extent, or other attributes of one or more rock formations in the subterranean zone. The geological data may include information collected from well logs, rock samples, outcroppings, seismic or microseismic imaging, or other data sources.

The one or more applications 758 may comprise one or more software applications, one or more scripts, one or more programs, one or more functions, one or more executables, or one or more other modules that are interpreted or executed by the processor 701. The one or more applications 758 may include one or more machine-readable instructions for performing one or more of the operations related to any one or more aspects of the present disclosure. The one or more applications 758 may include machine-readable instructions for detecting faults during hydraulic fracturing operations, as illustrated in FIGS. 1-6. The one or more applications 758 may obtain input data, such as seismic data, well data, treatment data, geological data, fracture data, or other types of input data, from the memory 704, from another local source, or from one or more remote sources (for example, via the one or more communication links 714). The one or more applications 758 may generate output data and store the output data in the memory 704, hard drive 707, in another local medium, or in one or more remote devices (for example, by sending the output data via the communication link 714).

Modifications, additions, or omissions may be made to FIG. 7 without departing from the scope of the present disclosure. For example, FIG. 7 shows a particular configuration of components of information handling system 700. However, any suitable configurations of components may be used. For example, components of information handling system 700 may be implemented either as physical or logical components. Furthermore, in one or more aspects, functionality associated with components of information handling system 700 may be implemented in special purpose circuits or components. In other aspects, functionality associated with components of information handling system 700 may be implemented in configurable general purpose circuit or components. For example, components of information handling system 700 may be implemented by configured computer program instructions.

Memory controller hub 702 may include a memory controller for directing information to or from various system memory components within the information handling system 700, such as memory 704, storage element 706, and hard drive 707. The memory controller hub 702 may be coupled to memory 704 and a graphics processing unit (GPU) 703. Memory controller hub 702 may also be coupled to an I/O controller hub (ICH) or south bridge 705. I/O controller hub 705 is coupled to storage elements of the information handling system 700, including a storage element 706, which may comprise a flash ROM that includes a basic input/output system (BIOS) of the computer system. I/O controller hub 705 is also coupled to the hard drive 707 of the information handling system 700. I/O controller hub 705 may also be coupled to an I/O chip or interface, for example, a Super I/O chip 708, which is itself coupled to several of the I/O ports of the computer system, including a keyboard 709, a mouse 710, a monitor 712 and one or more communications link 714. Any one or more input/output devices receive and transmit data in analog or digital form over one or more communication links 714 such as a serial link, a wireless link (for example, infrared, radio frequency, or others), a parallel link, or another type of link. The one or more communication links 714 may comprise any type of communication channel, connector, data communication network, or other link. For example, the one or more communication links 714 may comprise a wireless or a wired network, a Local Area Network (LAN), a Wide Area Network (WAN), a private network, a public network (such as the Internet), a wireless fidelity or WiFi network, a network that includes a satellite link, or another type of data communication network.

One or more embodiments of the present disclosure provide a system including at least one pump for pumping a fluid into a wellbore, a pressure sensor provided at a wellhead of the wellbore for measuring a backpressure of the fluid being pumped into the wellbore, and a diagnostic manager. The diagnostic manager includes at least one processor configured to: obtain pressure data associated with a pressure signal from the pressure sensor, wherein the pressure data includes pressure measurements of the fluid over a selected time period; convert, based on the pressure data, at least a portion of the pressure signal into frequency domain using a time domain to frequency domain transform method; detect a change in frequency of the pressure signal in the frequency domain; and determine that a fault associated with the wellbore has occurred based on the changed frequency of the pressure signal.

In one or more embodiments, the fluid includes a fracturing fluid being used to fracture a subterranean formation within a current zone of the wellbore during a multi-zone completion of the wellbore using, wherein the back pressure of the fracturing fluid is created by a plug placed within the wellbore isolating the current zone from a previous zone that is downhole from the current zone.

In one or more embodiments, the changed frequency includes a lower frequency of the pressure signal as compared to a baseline frequency of the pressure signal. The baseline frequency corresponds to normal oscillation frequency of the pressure signal as a result of pressure pulses travelling between wellhead and an expected position of the plug during a downhole treatment such as fracturing. The lower frequency corresponds to an oscillation frequency of the pressure signal due to back and forth travelling of a pressure pulse between the wellhead and the plug. The at least one processor is configured to determine, based on detecting the lower frequency, that a movement of the plug has occurred downhole from a current position of the plug.

In one or more embodiments, the at least one processor is further configured to calculate the oscillation frequency of the pressure pulse as an inverse of a period of oscillation of the pressure pulse in the time domain.

In one or more embodiments, the at least one processor is further configured to calculate a distance from the pressure sensor to the plug within the wellbore based on the oscillation frequency of the pressure signal and a known travelling velocity of the pressure pulse in the fluid, wherein the distance is indicative of a new depth of the plug within the wellbore when the fault corresponds to the movement of the plug downhole in the wellbore.

In one or more embodiments, the changed frequency includes a higher frequency of the pressure signal as compared to a baseline frequency of the pressure signal; the higher frequency corresponds to an oscillation frequency of the pressure signal due to back and forth travelling of a pressure pulse between the wellhead and an obstruction within the wellbore uphole from the plug restricting the flow of the fluid; the at least one processor is configured to: detect a reduced decay rate of a water hammer pressure wave of the pressure signal in the time domain along with the detecting of the higher frequency of the pressure signal in frequency domain; and determine, based on detecting at least one of the higher frequency or the reduced decay rate, that a screen out has occurred within the wellbore uphole from the plug.

In one or more embodiments, the at least one processor is further configured to calculate a distance from the pressure sensor to the obstruction within the wellbore based on the oscillation frequency of the pressure signal and a known travelling velocity of the pressure pulse in the fluid, wherein the distance is indicative of a location of the screen out within the wellbore.

In one or more embodiments, wherein the time domain to frequency domain transform method comprises Fast Fourier Transform, wavelet transform or other signal processing techniques for transforming signals from time domain to frequency domain.

One or more embodiments of the present disclosure provide a method for detecting wellbore faults, the method including obtaining pressure data associated with a pressure signal from a pressure sensor, wherein the pressure data includes backpressure measurements of a fluid being pumped into a wellbore over a selected time period; converting, based on the pressure data, at least a portion of the pressure signal into frequency domain using a time domain to frequency domain transform method; detecting a change in frequency of the pressure signal in the time domain; and determining that a fault associated with the wellbore has occurred based on the changed frequency of the pressure signal.

In one or more embodiments, the fluid includes a fracturing fluid being used to fracture a subterranean formation within a current zone of the wellbore during a multi-zone completion of the wellbore, wherein the back pressure of the fracturing fluid is created by a plug placed within the wellbore isolating the current zone from a previous zone that is downhole from the current zone.

In one or more embodiments, the changed frequency includes a lower frequency of the pressure signal as compared to a baseline frequency of the pressure signal; the lower frequency corresponds to an oscillation frequency of the pressure signal due to back and forth travelling of a pressure pulse between the wellhead and the plug; and the at least one processor is configured to determine, based on detecting the lower frequency, that a movement of the plug has occurred downhole from a current position of the plug.

In one or more embodiments, the method further includes calculating the oscillation frequency of the pressure pulse as an inverse of a period of oscillation of the pressure pulse in the time domain.

In one or more embodiments, the method further includes calculating a distance from the pressure sensor to the plug within the wellbore based on the oscillation frequency of the pressure signal and a known travelling velocity of the pressure pulse in the fluid, wherein the distance is indicative of a new depth of the plug within the wellbore when the fault corresponds to the movement of the plug downhole in the wellbore.

In one or more embodiments, the changed frequency includes a higher frequency of the pressure signal as compared to a baseline frequency of the pressure signal; the higher frequency corresponds to an oscillation frequency of the pressure signal due to back and forth travelling of a pressure pulse between the wellhead and an obstruction within the wellbore uphole from the plug restricting the flow of the fluid; the method further comprises: detecting a reduced decay rate of a water hammer pressure wave of the pressure signal in the time domain along with the detecting of the higher frequency of the pressure signal in frequency domain; and determining, based on detecting at least one of the higher frequency or the reduced decay rate, that a screen out has occurred within the wellbore uphole from the plug.

In one or more embodiments, the method further includes calculating a distance from the pressure sensor to the obstruction within the wellbore based on the oscillation frequency of the pressure signal and a known travelling velocity of the pressure pulse in the fluid, wherein the distance is indicative of a location of the screen out within the wellbore.

In one or more embodiments, wherein the time domain to frequency domain transform method comprises Fast Fourier Transform, wavelet transform or any other signal processing method for converting a signal from the time domain to the frequency domain.

One or more embodiments of the present disclosure provides a computer-readable medium for detecting wellbore faults. The computer-readable medium stores instructions which when executed by a processor perform a method comprising obtaining pressure data associated with a pressure signal from a pressure sensor, wherein the pressure data includes backpressure measurements of a fluid being pumped into a wellbore over a selected time period; converting, based on the pressure data, at least a portion of the pressure signal into frequency domain using a time domain to frequency domain transform method; detecting a change in frequency of the pressure signal in the frequency domain; and determining that a fault associated with the wellbore has occurred based on the changed frequency of the pressure signal.

In one or more embodiments, the fluid includes a fracturing fluid being used to fracture a subterranean formation within a current zone of the wellbore during a multi-zone completion of the wellbore, wherein the back pressure of the fracturing fluid is created by a plug placed within the wellbore isolating the current zone from a previous zone that is downhole from the current zone.

In one or more embodiment, the changed frequency includes a lower frequency of the pressure signal as compared to a baseline frequency of the pressure signal; the lower frequency corresponds to an oscillation frequency of the pressure signal due to back and forth travelling of a pressure pulse between the wellhead and the plug; and the at least one processor is configured to determine, based on detecting the lower frequency, that a movement of the plug has occurred downhole from a current position of the plug.

In one or more embodiments, the computer-readable medium further includes instructions for calculating a distance from the pressure sensor to the plug within the wellbore based on the oscillation frequency of the pressure signal and a known travelling velocity of the pressure pulse in the fluid, wherein the distance is indicative of a new depth of the plug within the wellbore when the fault corresponds to the movement of the plug downhole in the wellbore.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the elements that it introduces.

What is claimed is:

1. A method for detecting wellbore faults, comprising:

obtaining pressure data associated with a pressure signal from a pressure sensor, wherein the pressure data includes measurements of a back pressure of a fluid being pumped into a wellbore over a selected time period;

converting, based on the pressure data, at least a portion of the pressure signal into frequency domain using a transformation from a time domain to the frequency domain;

detecting a change in frequency of the pressure signal in the frequency domain; and determining that a fault associated with the wellbore has occurred based on the changed frequency of the pressure signal.

2. The method of claim 1, wherein the fluid includes a fracturing fluid being used to fracture a subterranean formation within a current zone of the wellbore during a multi-zone completion of the wellbore, wherein the back pressure of the fracturing fluid is created by a plug placed within the wellbore isolating the current zone from a previous zone that is downhole from the current zone.

3. The method of claim 2, wherein:

the changed frequency includes a lower frequency of the pressure signal as compared to a baseline frequency of the pressure signal;

the lower frequency corresponds to an oscillation frequency of the pressure signal due to back and forth travelling of a pressure pulse between a wellhead of the wellbore and the plug; and wherein the method comprises determining, based on detecting the lower frequency, that a movement of the plug has occurred downhole.

4. The method of claim 3, further comprising calculating the oscillation frequency of the pressure pulse as an inverse of a period of oscillation of the pressure pulse in the time domain.

5. The method of claim 3, further comprising calculating a distance from the pressure sensor to the plug within the wellbore based on the oscillation frequency of the pressure signal and a known travelling velocity of the pressure pulse in the fluid, wherein the distance is indicative of a new depth of the plug within the wellbore when the fault corresponds to the movement of the plug downhole in the wellbore.

6. The method of claim 2, wherein:

the changed frequency includes a higher frequency of the pressure signal as compared to a baseline frequency of the pressure signal;

the higher frequency corresponds to an oscillation frequency of the pressure signal due to back and forth travelling of a pressure pulse between a wellhead of the wellbore and an obstruction within the wellbore uphole from the plug restricting the flow of the fluid;

the method further comprising:

detecting a reduced decay rate of a water hammer pressure wave of the pressure signal in the time domain along with the detecting of the higher frequency of the pressure signal in the frequency domain; and determine, based on detecting at least one of the higher frequency or the reduced decay rate, that a screen out has occurred within the wellbore uphole from the plug.

7. The method of claim 6, further comprising calculating a distance from the pressure sensor to the obstruction within the wellbore based on the oscillation frequency of the pressure signal and a known travelling velocity of the pressure pulse in the fluid, wherein the distance is indicative of a location of the screen out within the wellbore.

8. The method of claim 1, wherein the transformation from the time domain to the frequency domain comprises a Fourier Transform, chirplet transform, or a wavelet transform.

9. The method of claim 1, wherein the fault associated with the wellbore comprises a fault associated with hydraulic fracturing of a subterranean formation into which the wellbore is formed.

10. The method of claim 9, wherein the fluid includes a fracturing fluid being used to fracture the subterranean formation within a current zone of the wellbore, wherein the fault associated with hydraulic fracturing comprises a movement of a plug placed within the wellbore isolating the current zone from another zone.

11. A system comprising:

at least one pump for pumping a fluid into a wellbore;

a pressure sensor provided at a wellhead of the wellbore for measuring a back pressure of the fluid being pumped into the wellbore; and a diagnostic manager having at least one processor configured to:

obtain pressure data associated with a pressure signal from the pressure sensor, wherein the pressure data includes pressure measurements of the fluid over a selected time period;

convert, based on the pressure data, at least a portion of the pressure signal into a frequency domain using a transformation from a time domain to the frequency domain;

detect a change in frequency of the pressure signal in the frequency domain; and determine that a fault associated with the wellbore has occurred based on the changed frequency of the pressure signal.

12. The system of claim 11, wherein the fluid includes a fracturing fluid being used to fracture a subterranean formation within a current zone of the wellbore during a multi-zone completion of the wellbore, wherein the back pressure of the fracturing fluid is created by a plug placed within the wellbore isolating the current zone from a previous zone that is downhole from the current zone.

13. The system of claim 12, wherein:

the changed frequency includes a lower frequency of the pressure signal as compared to a baseline frequency of the pressure signal;

the lower frequency corresponds to an oscillation frequency of the pressure signal due to back and forth travelling of a pressure pulse between the wellhead and the plug; and the at least one processor is configured to determine, based on detecting the lower frequency, that a movement of the plug has occurred downhole.

14. The system of claim 13, wherein the at least one processor is further configured to calculate the oscillation frequency of the pressure pulse as an inverse of a period of oscillation of the pressure pulse in the time domain.

15. The system of claim 13, wherein the at least one processor is further configured to calculate a distance from the pressure sensor to the plug within the wellbore based on the oscillation frequency of the pressure signal and a known travelling velocity of the pressure pulse in the fluid, wherein the distance is indicative of a new depth of the plug within the wellbore when the fault corresponds to the movement of the plug downhole in the wellbore.

16. The system of claim 12, wherein:

the changed frequency includes a higher frequency of the pressure signal as compared to a baseline frequency of the pressure signal;

the higher frequency corresponds to an oscillation frequency of the pressure signal due to back and forth travelling of a pressure pulse between the wellhead and an obstruction within the wellbore uphole from the plug restricting the flow of the fluid;

the at least one processor is further configured to:

detect a reduced decay rate of a water hammer pressure wave of the pressure signal in the time domain along with the detecting of the higher frequency of the pressure signal in the frequency domain; and determine, based on detecting at least one of the higher frequency or the reduced decay rate, that a screen out has occurred within the wellbore uphole from the plug.

17. The system of claim 16, wherein the at least one processor is further configured to calculate a distance from the pressure sensor to the obstruction within the wellbore based on the oscillation frequency of the pressure signal and a known travelling velocity of the pressure pulse in the fluid, wherein the distance is indicative of a location of the screen out within the wellbore.

18. The system of claim 11, wherein the time domain to frequency domain transform method comprises a Fourier transform, a chirplet transform, or a wavelet transform.

19. The system of claim 11, wherein the fault associated with the wellbore comprises a fault associated with hydraulic fracturing of a subterranean formation into which the wellbore is formed.

20. The system of claim 19, wherein the fluid includes a fracturing fluid being used to fracture the subterranean formation within a current zone of the wellbore, wherein the fault associated with hydraulic fracturing comprises a movement of a plug placed within the wellbore isolating the current zone from another zone.

21. A computer-readable medium for detecting wellbore faults, the computer-readable medium storing instructions which when executed by a processor perform a method comprising:

obtaining pressure data associated with a pressure signal from a pressure sensor, wherein the pressure data includes measurements of a back pressure of a fluid being pumped into a wellbore over a selected time period;

converting, based on the pressure data, at least a portion of the pressure signal into frequency domain using a transformation from a time domain to the frequency domain;

detecting a change in frequency of the pressure signal in the frequency domain; and determining that a fault associated with the wellbore has occurred based on the changed frequency of the pressure signal.

22. The computer-readable medium of claim 21, wherein the fluid includes a fracturing fluid being used to fracture a subterranean formation within a current zone of the wellbore during a multi-zone completion of the wellbore, wherein the back pressure of the fracturing fluid is created by a plug placed within the wellbore isolating the current zone from a previous zone that is downhole from the current zone.

23. The computer-readable medium of claim 22, wherein:

the changed frequency includes a lower frequency of the pressure signal as compared to a baseline frequency of the pressure signal;

the lower frequency corresponds to an oscillation frequency of the pressure signal due to back and forth travelling of a pressure pulse between a wellhead of the wellbore and the plug; and wherein the method comprises determining, based on detecting the lower frequency, that a movement of the plug has occurred downhole.

24. The computer-readable medium of claim 23, wherein the instructions comprise instructions for calculating a distance from the pressure sensor to the plug within the wellbore based on the oscillation frequency of the pressure signal and a known travelling velocity of the pressure pulse in the fluid, wherein the distance is indicative of a new depth of the plug within the wellbore when the fault corresponds to the movement of the plug downhole in the wellbore.

* * * * *